US009968995B2

(12) United States Patent
Charles et al.

(10) Patent No.: US 9,968,995 B2
(45) Date of Patent: May 15, 2018

(54) TAPERED THREADED PULLER HEAD

(71) Applicant: RETECH SYSTEMS LLC, Ukiah, CA (US)

(72) Inventors: Matthew A. Charles, Cloverdale, CA (US); Paul G. Meese, Healdsburg, CA (US)

(73) Assignee: Retech Systems LLC, Ukiah, CA (US)

( * ) Notice: Subject to any disclaimer, the term of this patent is extended or adjusted under 35 U.S.C. 154(b) by 139 days.

(21) Appl. No.: 15/140,174

(22) Filed: Apr. 27, 2016

(65) Prior Publication Data

US 2016/0325346 A1 Nov. 10, 2016

Related U.S. Application Data

(60) Provisional application No. 62/158,270, filed on May 7, 2015, provisional application No. 62/156,731, filed on May 4, 2015.

(51) Int. Cl.
*B22D 11/08* (2006.01)

(52) U.S. Cl.
CPC ..... *B22D 11/083* (2013.01); *B22D 11/081* (2013.01)

(58) Field of Classification Search
CPC ..... B22D 11/081; B22D 11/083
USPC ..... 164/445, 483
See application file for complete search history.

(56) References Cited

U.S. PATENT DOCUMENTS

| | | | | |
|---|---|---|---|---|
| D32,879 | S | 5/1900 | Rubin | |
| 2,176,990 | A | 10/1939 | Crampton | |
| 3,525,381 | A | 8/1970 | Leese et al. | |
| 3,602,290 | A | 8/1971 | Schmidt et al. | |
| 3,643,731 | A | 2/1972 | Stull | |
| 3,730,251 | A | 5/1973 | Webbere et al. | |
| 4,252,179 | A | 2/1981 | Scholtze et al. | |
| 4,434,839 | A | 3/1984 | Vogel | |
| 5,651,935 | A | 7/1997 | Matsukura | |
| 6,033,609 | A | 3/2000 | Wright | |
| 6,533,570 | B2 | 3/2003 | Meyer | |
| 6,620,448 | B2 | 9/2003 | Keller | |
| 7,004,229 | B2 * | 2/2006 | Salee | B22D 11/103 164/136 |

(Continued)

FOREIGN PATENT DOCUMENTS

FR 2779673 A1 * 12/1999 ..... B22D 11/083

OTHER PUBLICATIONS

International Search Report and Written Opinion received by the International Searching Authority in application No. PCT/US2016/029548; 11 pages.

(Continued)

*Primary Examiner* — Kevin E Yoon
(74) *Attorney, Agent, or Firm* — Kilpatrick Townsend & Stockton LLP

(57) ABSTRACT

A puller head mold for receiving molten metal or alloy during the casting of an ingot, the puller head mold having a tapered screw thread structure. The tapered threaded puller head is used to pull and withdraw a cast ingot from a casting furnace, and can be particularly useful for the handling of ingots having a relatively narrow diameter. The tapered threaded puller head profile provides for full release of the tapered threaded puller head from a cast ingot in a fraction of a turn. The size and profile of the cast ingot formed with the tapered threaded puller head is resilient to thermal gradients while cooling.

19 Claims, 8 Drawing Sheets

(56) References Cited

U.S. PATENT DOCUMENTS

| | | | |
|---|---|---|---|
| D521,032 | S | 5/2006 | Sakamoto |
| D568,347 | S | 5/2008 | Manera |
| D631,073 | S | 1/2011 | Papa |
| D646,700 | S | 10/2011 | Takeuchi |
| D696,317 | S | 12/2013 | Carper |
| D699,769 | S | 2/2014 | Witz |
| D699,770 | S | 2/2014 | Kmoch |
| D700,224 | S | 2/2014 | Kmoch |
| D736,280 | S | 8/2015 | Myrhum, Jr. |
| 2003/0020204 | A1 | 1/2003 | Davidson |
| 2004/0241266 | A1 | 12/2004 | Neubauer |
| 2005/0126744 | A1 | 6/2005 | Salee et al. |

OTHER PUBLICATIONS

Notice of Allowance dated Apr. 22, 2016 by the U.S. Patent and Trademark Office for Design U.S. Appl. No. 29/525,990.

* cited by examiner

100

TAPERED THREADED PULLER HEAD

CROSS-REFERENCE TO RELATED APPLICATIONS

This application claims priority to U.S. Provisional Application Ser. No. 62/156,731 filed May 4, 2015, entitled "TAPERED THREADED PULLER HEAD," and to U.S. provisional Application Ser. No. 62/158,270 filed May 7, 2015, entitled "TAPERED THREADED PULLER HEAD," the disclosures of which are hereby incorporated by reference in their entirety.

FIELD OF THE INVENTION

The present disclosure relates to an apparatus and method of use for forming and withdrawing cast metals ingots from a furnace melting system. The apparatus and method is particularly useful for the formation of ingots made of reactive metals or specialty or complex metal alloys, for the formation of ingots with a relatively small or narrow diameter, or ingot forming furnace systems with a limited throughput.

BACKGROUND OF THE INVENTION

A controlled atmosphere furnace melting system for forming ingots requires a means to withdraw a cast ingot from the furnace melting system. In the standard practice of ingot formation, a puller-head mold structure, such as a dovetail mold or a conventional threaded puller-head mold, is commonly used to withdraw a cast ingot. Often, puller-head mold structures are constructed with a channel, cavity, or slot to receive and capture the first casting of molten metal into the mold. That first casting into the channel, cavity, or slot serves to mechanically lock the initial portion of the overall semi-continuous casting onto or into the moveable bottom of the mold. This mechanical locking provides a location from which the casting can be pulled, and thus allows all subsequent cast and solidified material to be withdrawn from the mold, allowing room for more casting of molten metal which in turn is solidified and withdrawn, thereby forming an ingot. However, traditional puller-head mold structures present disadvantages when used for ingots having a relatively small diameter, or ingot formation of certain specialty or complex metal alloys.

Dovetail puller-heads can be constructed with two or more complementary or matching parts forming a channel, cavity, or slot, where the two or more complementary or matching parts can separate from around a cast ingot once the ingot has cooled. Slotted dovetail retention puller-heads, however, can sometimes fail under high tensile forces when there is a relatively low contact area between the ingot and dovetail puller-head structure, which can be limited to the area of the mechanically-locked portion of the casting. Removing the ingot with a dovetail puller-head structure can also require horizontal sliding of the ingot, pulling the ingot by the mechanically-locked portion of the casting, which exposes the ingot to mechanical forces that can cause galling, and thus can be particularly difficult to perform with long ingots. A further disadvantage is that molten material can also run out of the open end of the dovetail slot and cause binding of the ingot with the dovetail puller-head structure. Further, if the interface portion of the dovetail puller-head gets stuck in the middle of the withdrawal mold, then there is no way to remove the dovetail puller-head from the ingot without causing major damage to the mold and puller, and potentially damaging the ingot as well.

The construction of two-piece removable dovetails also have many drawbacks. Being constructed of separate pieces of material, the components of two-piece dovetail can suffer from poor heat transfer to the directly water cooled components of the withdrawal system. This can cause the dovetail to overheat or even melt. Further, using two-piece dovetails generally requires removing multiple small fasteners in order to remove the dovetails. This presents safety issues due to the operator having to work around the base of a potentially large, heavy, and extremely hot ingot. Moreover, such fasteners are generally steel components, which can overheat, melt, and/or become galled and brittle. Casting material can also run out of, around, and through the edge surfaces of the two separate pieces of the dovetail. Molten metal can also end up cast into, along, or in the spaces between, the edge surfaces of the two-piece structure, requiring that such casting be cut or ground out of the dovetail mold.

Conventional, basic threaded puller-head molds that include a female threaded hole in the puller-head into which molten material can be cast also suffer from problematic casting and formation issues. Such threaded puller-head molds generally have no relief, and the shrinkage of the cast metal upon cooling causes binding and galling along the interior wall of the mold. Known threaded puller-head molds are also generally limited in cross-section, which can lead to poor ingot to puller connection strength which can lead to breakage.

Accordingly, there remains a need for a puller head mold structure that can be used to withdraw a cast ingot from a furnace melting system without disadvantages known in the field.

BRIEF SUMMARY OF THE INVENTION

The following presents a simplified summary of some embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

For at least the reasons given above, it is desirable to design a casting mold to receive and define the base of an ingot cast from specialty or complex metals or alloys. Further, it is desirable to configure the mold to form an ingot base that is easily removable from the casting mold. Moreover, it is desirable to form control an ingot base configured to be used for specific purposes in post-casting applications.

Embodiments of the present disclosure provide for a puller head casting mold that includes: a mold body having an annular shape with an upper surface, a bottom surface, a radial surface, and an interior screw thread surface; where the interior screw thread surface defines an interior cavity, and the interior screw thread surface is tapered to narrow a diameter of the interior cavity along an axis normal to the mold body from the upper surface to the bottom surface. In some aspects, the puller head casting mold upper surface has an opening that further defines an upper plane of the casting space. In other aspects, the puller head casting mold has a taper angle for the threaded interior surface of about 0° to about 180°, and in some specific aspects a taper angle of about 60°. In further aspects, the threaded interior surface has a curved crest surface forming a rounded thread or a partially spherical thread. In such aspects, the threaded interior surface can also have a root surface that is about 10% or less of the width of the curved crest surface. In other aspects, the threaded interior surface can also have a root surface that is about 5% the width of the curved crest surface. In some aspects, the mold body includes one or more interior passages, where each interior passage has a first aperture in the radial surface and a second aperture in the bottom surface. In such aspects, each of the one or more interior passages can extend into the mold body from the radial surface about half the radius of the annular mold body. In other aspects, the puller head casting mold further includes a beveled edge connecting the upper surface and the radial surface, having a bevel angle of from about 5° to about 60° below the upper surface. Further, the puller head casting mold can be configured to form ingots having a main body with a diameter of about two inches to four inches.

Further embodiments of the present disclosure provide for a method of forming a cast ingot, including the steps of: positioning a tapered threaded puller head having an interior cavity proximate to an extrusion port of a furnace casting system; casting an ingot in the furnace casting system, wherein one end of the ingot passes through the extrusion port and is cast within the interior cavity of the tapered threaded puller head; withdrawing the ingot from the furnace casting system by moving the tapered threaded puller head away from the extrusion port, concurrently pulling the ingot out of the extrusion port; and decoupling the tapered threaded puller head from the ingot. In some aspects, decoupling the tapered threaded puller head from the ingot includes rotating the cast ingot less than a full turn relative to the tapered threaded puller head. In particular aspects, decoupling the tapered threaded puller head from the ingot includes rotating the cast ingot a quarter-turn relative to the tapered threaded puller head or a sixth-turn relative to the cast ingot. In other aspects, the method results in producing a cast ingot that has a main body diameter of about two inches to four inches. In further aspects, the method results in producing a cast ingot that has a tapered male screw end.

For a more complete understanding of the nature and advantages of the present invention, reference should be made to the ensuing detailed description and accompanying drawings.

BRIEF DESCRIPTION OF THE DRAWINGS

Illustrative aspects and embodiments are described in detail below with reference to the following drawing figures.

DETAILED DESCRIPTION OF THE INVENTION

Figure 1:
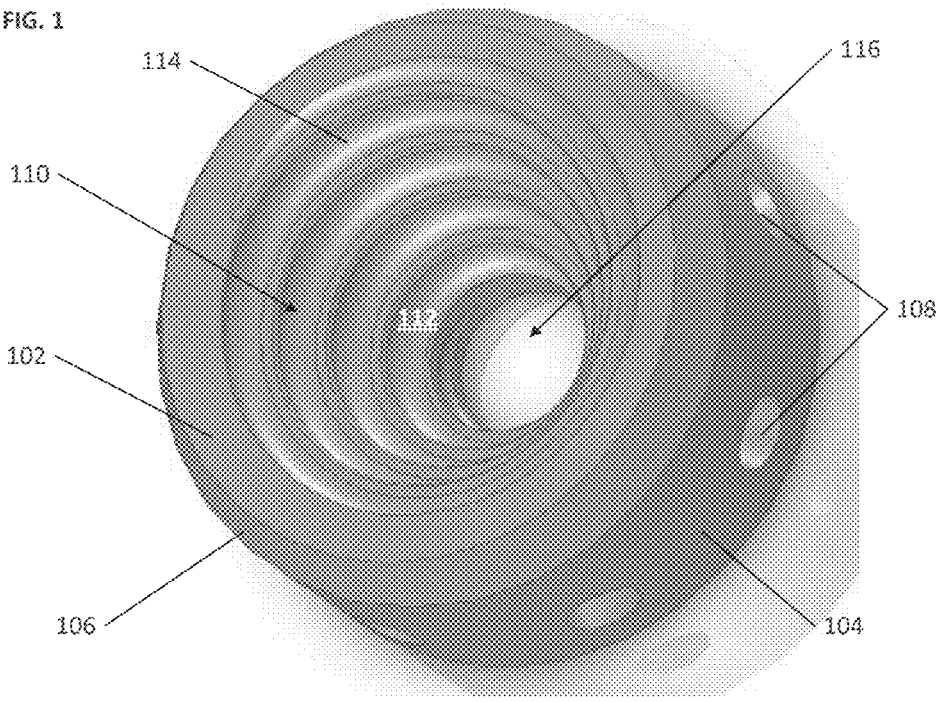
FIG. 1 is a top perspective view of a tapered treaded puller head casting mold having an annular or cylindrical shape, in accordance with some embodiments of the present disclosure.

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In other instances, well-known structures and devices are shown in diagram or schematic form to avoid obscuring the underlying principles of the described embodiments.

The present disclosure provides for a tapered threaded puller-head and related method for forming ingots where the tapered threaded puller-head is securely held to an ingot being withdrawn, yet is easily and quickly removed from the ingot with minimal effort. The tapered threaded puller-head according the present disclosure allows for the production of ingots with certain dimensions with greater efficiency and throughput than traditional puller-heads, in some aspects decreasing system turnaround time by about 12.5%, relatively. The tapered threaded puller-head according the present disclosure further reduces the amount of ingot scrap produced, due to both of fewer ingots experiencing breakage or catastrophic failure during cooling and a reduction in breakage or galling during the casting process.

Ingots formed from specialty, rare, or relatively complex metal alloys can have thermal and/or structural properties that make conventional ingot casting processes challenging or unsuited for such alloys. Standard-sized ingots, referred to herein as "standard-core ingots", are ingots having a diameter or six inches (6") or greater. Standard-core ingots that are formed from alloys of titanium aluminide alloy (TiAl), silicon (Si), and the like can experience structural failure during solidification. Alloys made from these or other relatively brittle metals, when cast as standard-core ingots, may experience too drastic a temperature gradient between or temperature shock from the exterior of the ingot to the interior of the ingot during cooling of the ingot. The temperature gradient can thereby lead to cracking or complete breaking of such ingots. Similarly, ingots produced by continuous or semi-continuous extrusion processes, which have an indefinite length until cut from a casting furnace, can also be subject to such structural failure while solidifying due in part to the difference in temperature along the length of the ingot.

The adverse thermal effects of solidification on some alloy ingots, including standard-core ingots, can be reduced by forming ingots having a reduced cross section. Reduced cross-section ingots, referred to herein as "narrow-core ingots", can be ingots having a diameter of about two to four inches (2"-4"). During the solidification process, ingots having a diameter of about two to four inches are less prone to develop temperature gradients between the exterior of the ingot to the interior of the ingot that may lead to cracking or other structural failure. In further embodiments, ingots having a diameter of less than two inches (<2") can be formed and used according to the present disclosure. A method and apparatus to remove or withdraw a narrow-core ingot from a casting furnace can be to use a tapered threaded puller head that acts as a mold (alternatively referred to as a "TTPH mold") for one end of the narrow-core ingot. In some aspects, narrow-core ingots can be ingots having a length of about twenty to twenty-five inches (20"-25"). During the curing process, ingots having a length of about twenty to twenty-five inches (20"-25") can be less prone to develop temperature gradients along the length of the ingot that may lead to cracking or other structural failure. Thus in some implementations, limiting the length of a narrow-core ingot can reduce the throughput of a casting furnace system, as opposed to traditional continuous or semi-continuous extrusion processes. Nevertheless, in alternative implementations, for formation of a narrow-core ingot can be controlled such that the narrow-core ingot can be formed having a length of one meter or longer.

A TTPH mold configured to couple with a casting furnace for forming narrow-core ingots can be positioned below or at the end of a casting furnace port to receive molten metal from the casting furnace. The TTPH mold has an open top proximate to the casting furnace, and can be either a closed-bottom mold or an open-bottom mold, the bottom of the TTPH mold being distal from the casting furnace. An open-bottom mold can be secured on a platform or with a cap such that molten metal does not pass through the TTPH mold, where the platform or cap can be removed along with the TTPH mold once the casting has cooled to form a metal ingot. The molten metal cast from the casting furnace fills the female cavity of the TTPH mold, and when cooled, forms a male end of a metal ingot that matches the female cavity of the TTPH mold.

The interior surface of the TTPH mold is shaped to have a helical thread. The helical thread can have a constant pitch, having a rounded or partially spherical thread form perpendicular to the normal axis of the thread, and having a linearly and equally varying minor, pitch, major, crest, and root diameters along the length of the thread. The linear and equally varying diameters for these parameters provide for a mold construction resulting in a thread of tapered form along the interior surface. In other words, the major diameter of the thread linearly decreases when viewed along the normal axis of the thread from the top of the mold toward the bottom of the mold. For a rounded or partially spherical thread, the root diameter can define the curvature of the thread form and depth of engagement at a given section of the thread. Where the root diameter for subsequent rounded thread forms is greater than the diameter of the crest tread form between the subsequent rounded thread forms, the cast material in the TTPH mold shrinks when curing/solidifying in a manner that minimizes the galling of the cast solidified male thread when removed from the female threaded TTPH mold. Similarly, a thread form where the root surface of the thread is wider or taller than the crest surface of the thread can provide for a shape where the cast material in the TTPH mold shrinks when curing/solidifying in a manner that minimizes the galling of the cast solidified male thread when removed from the female threaded TTPH mold.

In alternative embodiments, the thread form of the tapered thread can be a V-shaped thread, an Acme thread, a knuckle thread, a Whitworth thread, a stub thread, a buttress thread, or other thread forms. In such thread form embodiments, the root surface of the thread can be wider or taller than the crest surface of the thread to thereby an provide for a shape where the cast material in the TTPH mold shrinks when curing/solidifying in a manner that minimizes the galling of the cast solidified male thread when removed from the female threaded TTPH mold The structure and characteristics of the TTPH mold include, in some aspects, a taper angle of the screw thread, a desired number of threads along the height of the screw thread, and a degree of rotational engagement. In some embodiments, the TTPH mold can have an have a taper angle of about 60°, where the taper angle correlates to the pitch line of the thread relative to the normal axis of the thread. In other embodiments, the TTPH mold can have an have a taper angle of about 15°, about 30°, about 45°, about 75°, or at an angle having an increment or gradient within the range of about 0° to about 180°. In other embodiments, the thickness of the thread, measured along the height of the TTPH mold can be selected to provide for a specific number of threads in the TTPH mold. In exemplary embodiments, the overall screw thread of the TTPH mold can have three, four, five, six, seven, eight, or more threads. In various embodiments the base of the thread can be one-eighth of an inch (⅛"), one-quarter of an inch (¼"), three-eighths of an inch (⅜"), or an other length to provide for a desired number of threads of length of engagement.

The combination of taper angle and the number of threads of the screw thread in the TTPH mold can determine the degree of rotational engagement for the TTPH mold. The degree of rotational engagement refers to the fraction of lead that the TTPH mold needs to be turned to disengage from a cast ingot. In other words, once an ingot is withdrawn from a casting furnace system via a puller mechanism mechanically coupled to the TTPH mold, the TTPH mold is disengaged from the ingot to allow the ingot to cool; the degree of rotational engagement is the amount of rotation that will cause the TTPH mold to release from the ingot. In some embodiments, the degree of rotational engagement needed to disengage the TTPH mold from the ingot (where a single turn is 360° of rotation) can be a half-turn (180°), a third-turn (120°), a quarter-turn (90°), a sixth-turn (60°), an eighth-turn (45°), or a turn at other increments or gradients within a single turn range. The degree of rotational engagement can be a function of the depth of engagement or the length of engagement, as well as the taper angle and the number of threads in the screw thread.

The tapered thread for the TTPH mold disclosed herein can be embodied in many different forms. In one embodiment, the TTPH mold provides a female cavity for retention of cast and subsequently solidified molten material. In an alternative embodiment, the TTPH mold can include a male thread, manufactured either by a machining process or from casting into a female cavity.

As used herein, the term "female" refers to a shape or cavity that corresponds in shape to the negative of a finished ingot casting. The interior surface of a mold can define the shape of a given female cavity. Conversely, the term "male" as used herein refers to the shape of a finished ingot casting that is complementary with a corresponding female cavity.

FIG. 1 is a top perspective view of a TTPH mold 100, having an annular or cylindrical shape. The TTPH mold 100 has a upper surface 102 that, when coupled to a casting furnace, is proximate to the port of the casting furnace from which molten metal is cast or extruded. The TTPH mold 100 has an radial surface 104 (alternatively referred to as a radial sidewall) that defines the exterior sides of the TTPH mold 100, where the radial surface 104 can be perpendicular to the plane of the upper surface 102. The TTPH mold 100 can have a diameter of about two inches to about six inches (2"-6"). In some aspects, the TTPH mold 100 can have a beveled edge 106 connecting the upper surface 102 and the radial surface 104. The beveled edge 106 can have a bevel angle (measured from the plane of the upper surface 102 to the radial surface 104) of from about five degrees to about sixty degrees (5°-60°) below the upper surface 102. In some embodiments, the radial surface 104 can have one or more radial apertures 108 configured to receive nuts for securing the TTPH mold, leading to interior passages that extend through the interior body of the TTPH mold 100. In some aspects, the radial apertures 108 can be configured to receive barrel nuts, a barrel nut being a section of round bar having one or more tapped holes. Barrel nuts, and other such nuts are generally designed to resist tear-out in structures made of copper or other soft metals. In such embodiments, the apertures can be equally distributed around the body of the TTPH mold 100, or in other embodiments asymmetrically distributed around the body of the TTPH mold 100. In some embodiments, the TTPH mold 100 can have a height of about one inches to about three inches (1"-3").

The upper surface 102 of the TTPH mold 100 can have an upper opening 110 to an interior cavity 112 of the TTPH mold 100, the interior cavity 112 being defined in part by an interior screw thread surface 114 of the TTPH mold 100. The interior cavity 112 of the TTPH mold 100 narrows along an axis normal to the interior screw thread surface 114, when viewed from upper opening 110 in the upper surface 102 of the TTPH mold 100 toward the bottom of the TTPH mold 100. Accordingly, the interior screw thread surface 114 has a wide end at the top of the TTPH mold 100 and a narrow end at the bottom of the TTPH mold 100. In some embodiments, the TTPH mold 100 is an open-bottom mold with a bottom opening 116. In other embodiments, the TTPH mold 100 is a closed-bottom mold without a bottom opening.

Figure 2:
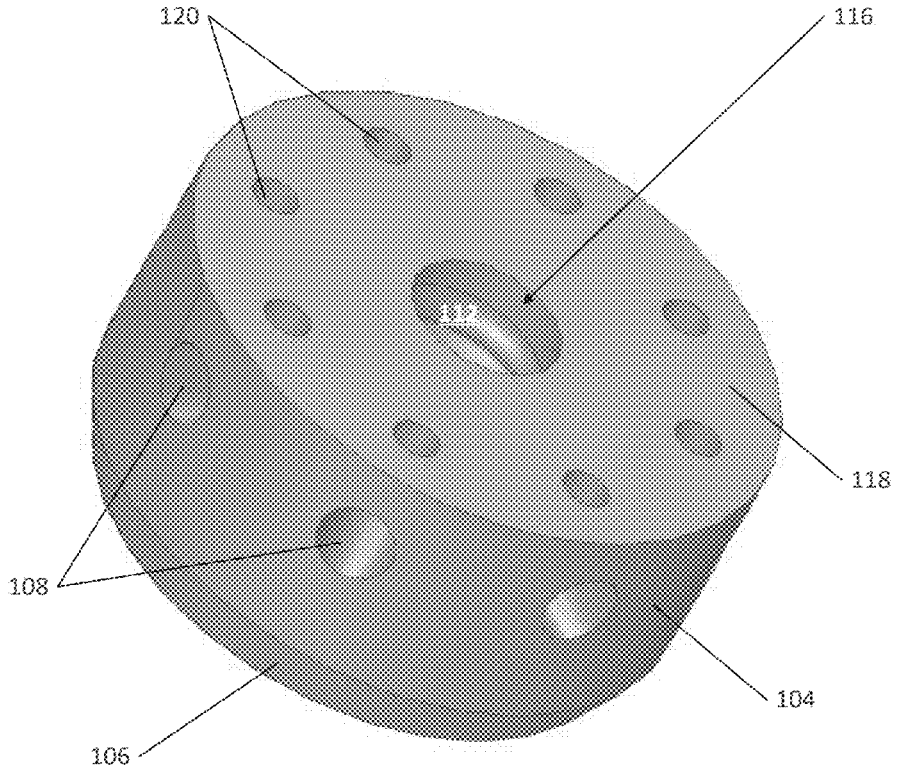
FIG. 2 is a bottom perspective view of a tapered treaded puller head casting mold, in accordance with some embodiments of the present disclosure.

FIG. 2 is a bottom perspective view of a TTPH mold 100. The TTPH mold 100 includes a bottom surface 118 which further includes one or more ventral apertures 120 to interior passages (also referred to as bolt holes) that extend through the interior body of the TTPH mold 100. In some aspects, each individual interior passage connects one radial aperture 108 with a corresponding ventral aperture 120. Bolts from a puller mechanism (not shown) can extend through the ventral apertures 120 and into nuts located in the corresponding radial apertures 108. Accordingly, a puller mechanism can exert force on the TTPH mold 100 through its bolts that is evenly distributed throughout the area of the TTPH mold. In other aspects one or more interior passage can connect one or more radial apertures 108 with one or more corresponding ventral apertures 120. In open-bottom embodiments of the TTPH mold 100, the bottom surface 118 can include a bottom opening 116 that opens to the interior cavity 112.

Figure 3:
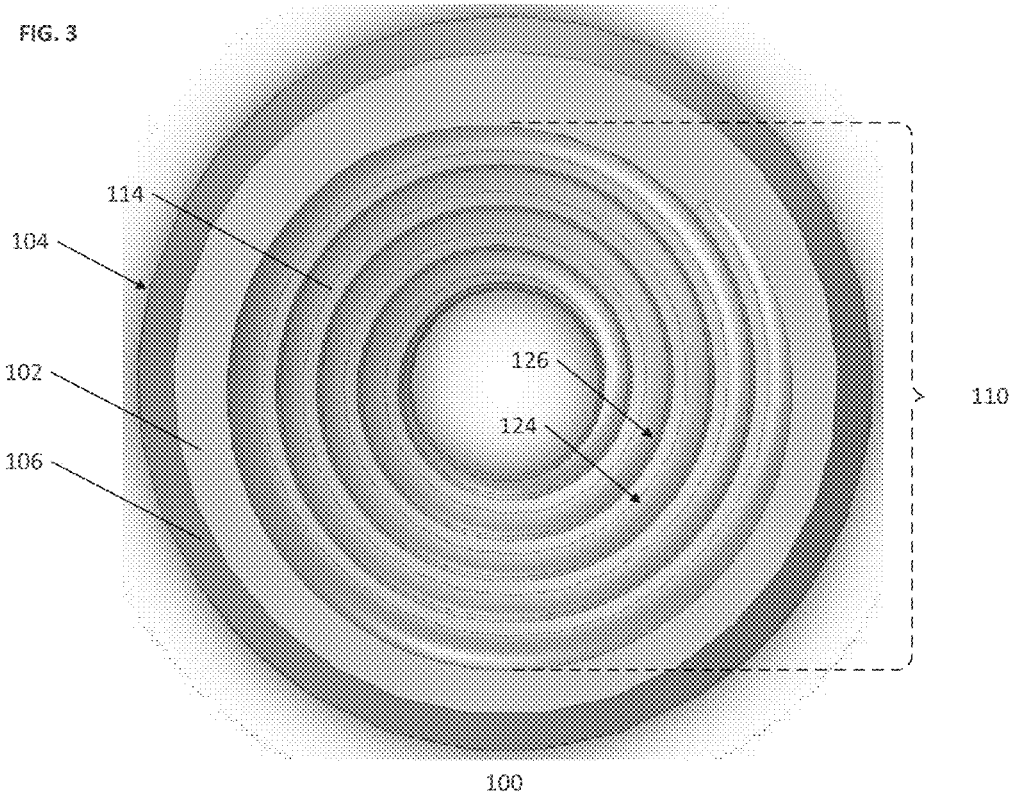
FIG. 3 is a top plan view of a tapered treaded puller head casting mold, in accordance with some embodiments of the present disclosure.

FIG. 3 is a top plan view of a TTPH mold 100, providing a further view of the upper surface 102 and upper opening 110 of the TTPH mold 100. As illustrated, the wide end of the interior screw thread surface 114 can define the size and shape of the upper opening 110 in the upper surface 102. The interior screw thread surface 114 has a curved root surface 124 with a crest surface 126 therebetween. The base of the thread of the curved root surface 124 can be relatively larger than the width of the crest surface 126. Minimizing the width of the crest surface 126 relative to the base of the thread of the curved root surface 124 can reduce the risk or amount of galling to the spaces between threads when a cast ingot is decoupled from the TTPH mold 100. In certain embodiments, the crest surface 126 can have a width of about 5% to about 20% the width of the curved root surface 124, such as a width 10% or less of the width of the curved root surface 124, or another width at increments or gradients within the range of about 5% to about 20% the width of the curved root surface 124. In yet further embodiments, the crest surface 126 can have a width of less than 5% the width of the curved root surface 124. In some embodiments, both the base of the thread of the curved root surface 124 and the width of the crest surface 126 can be constant along the length of the interior screw thread surface 114. In other embodiments, the base of the thread of the curved root surface 124 and the width of the crest surface 126 can increase or decrease along the length of the interior screw thread surface 114. The larger the width of the curved root surface 124 relative to the width of the crest surface 126, the looser the TTPH mold 100 and casting will be after solidification.

Figure 4:
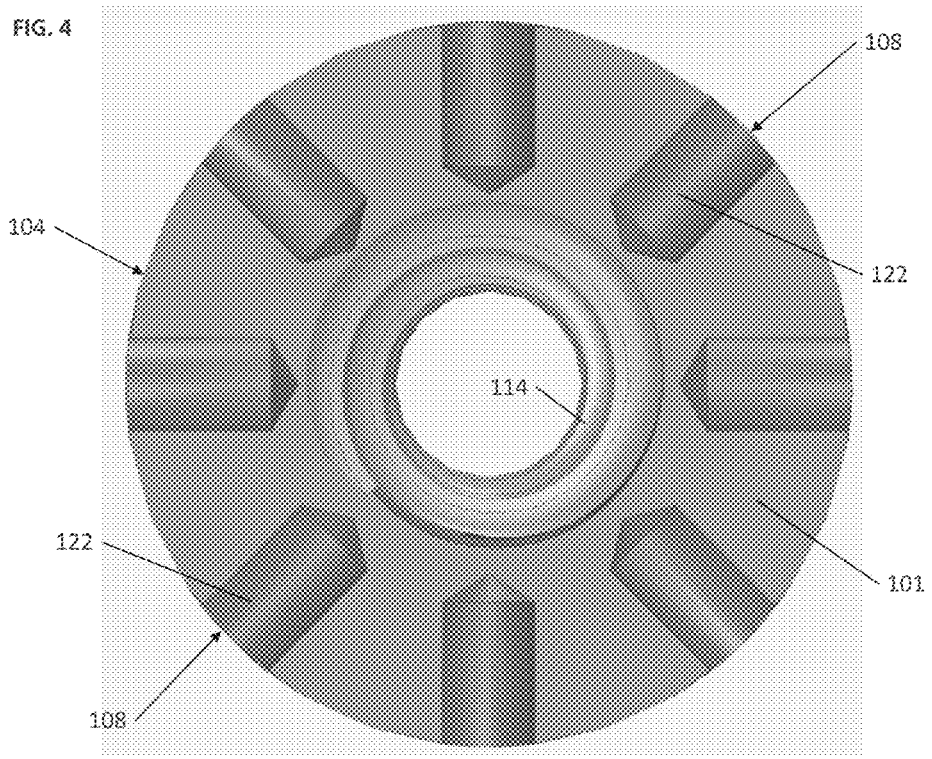
FIG. 4 is a top cross-sectional view of a tapered treaded puller head casting mold, in accordance with some embodiments of the present disclosure.

FIG. 4 is a top cross-sectional view of a TTPH mold 100, providing a view of the interior passages 122 that extend through the body 101 of the TTPH mold 100. In some aspects, the interior passages 122 can be drilled into the TTPH mold 100. The radial apertures 108 in the radial surface 104 of the TTPH mold 100 allow for nuts, such as a barrel nuts, to be positioned in the interior passages 122. The interior passages 122 extend into the body 101 of the TTPH mold 100 toward the interior screw thread surface 114, where each interior passage 122 can have a portion of structure proximate to the interior screw thread surface 114 having a conical, rounded, hemispherical, flat, or angled shape.

Figure 5:
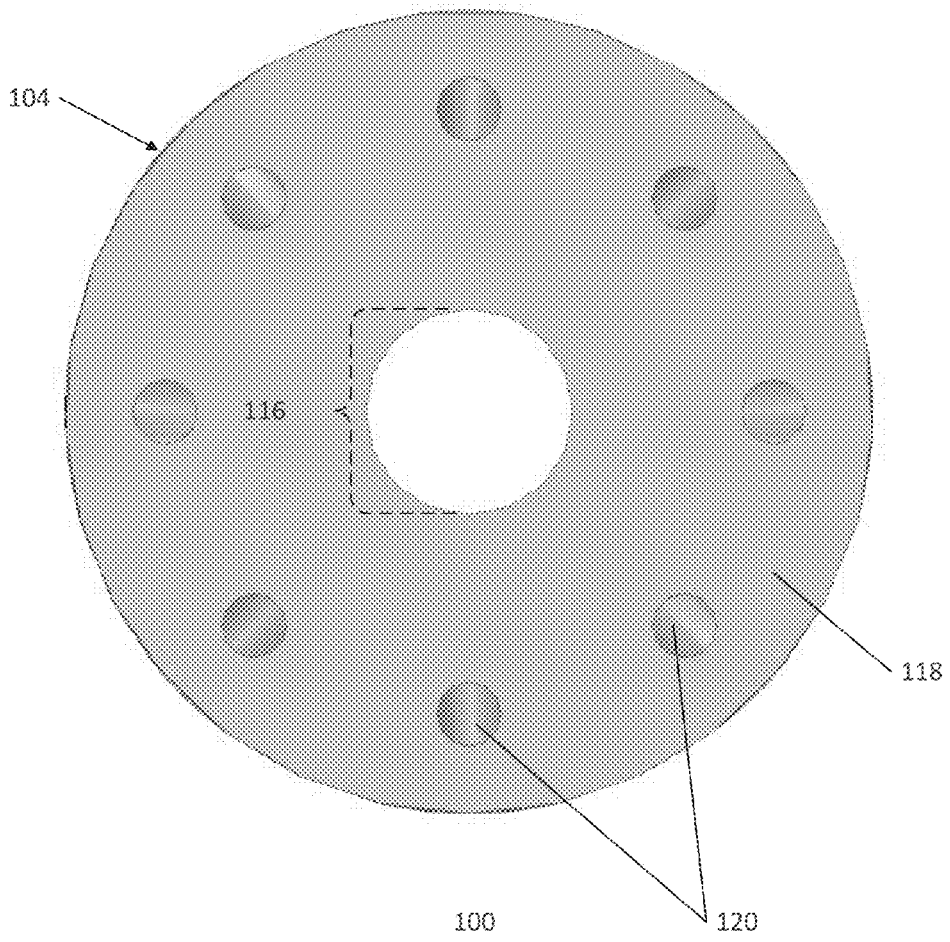
FIG. 5 is a bottom plan view of a tapered treaded puller head casting mold, in accordance with some embodiments of the present disclosure.

FIG. 5 is a bottom plan view of a TTPH mold 100, providing a further view of the bottom surface 118 and bottom opening 116 of the TTPH mold 100. As illustrated, the narrow end of the interior screw thread surface 114 can define the size and shape of the bottom opening 116 in the bottom surface 118. The ventral apertures 120 in the bottom surface 118 can be positioned equidistant from each other or in an asymmetric or unbalanced configuration. In further embodiments, the edge of the bottom opening 116 leading to the interior screw thread surface 114 can be perpendicular to the bottom surface 118 or angled to provide for a gradual change of angle from the taper angle of the screw thread.

Figure 6:
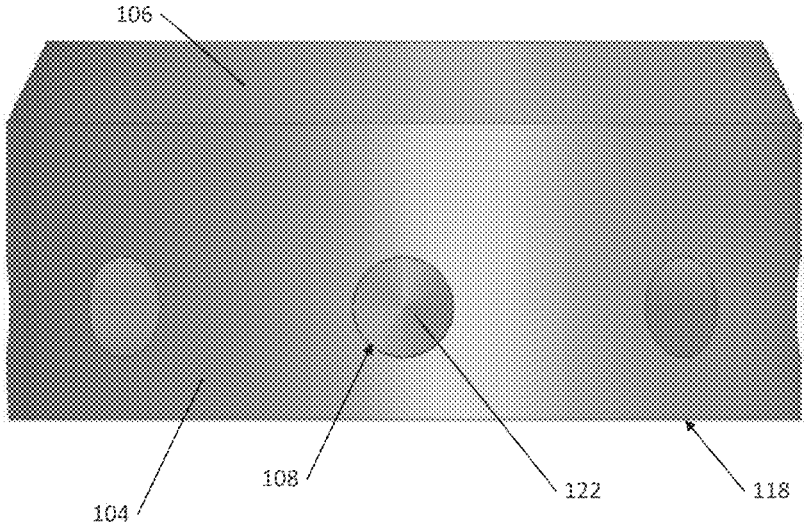
FIG. 6 is a side elevation view of a tapered treaded puller head casting mold, in accordance with some embodiments of the present disclosure.

FIG. 6 is a side elevation view of a TTPH mold 100, providing a further view of the radial apertures 108 and the interior passages 122. The radial apertures 108 in the radial surface 104 can be positioned equidistant from each other or in an asymmetric or unbalanced configuration. The interior passages 122 can be positioned in the TTPH mold 100 between the bottom surface 118 and the intersection between the radial surface 104 and the beveled edge 106. The radial apertures 108 can provide openings to the interior passages 122 at a height in the radial surface 104 corresponding to the position of the interior passages 122 in the TTPH mold 100. In some aspects, the interior passages 122 can be from about half-an-inch to about one inch (½"-1") up from the bottom surface 118 along the height of the radial surface 104.

Figure 7:
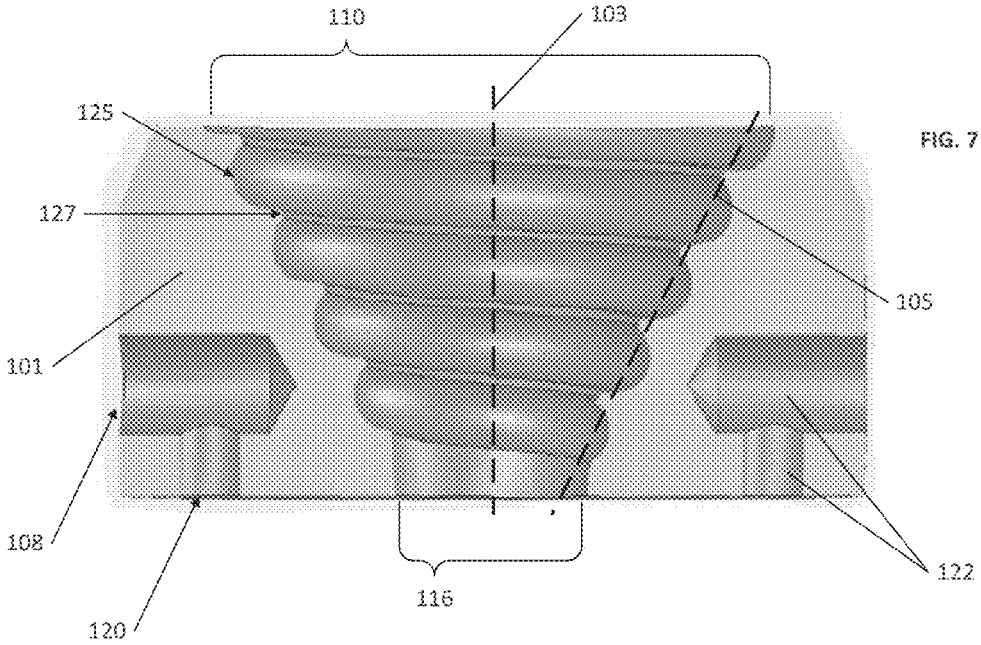
FIG. 7 is a side cross-sectional view of a tapered treaded puller head casting mold, in accordance with some embodiments of the present disclosure.

FIG. 7 is a side cross-sectional view of a TTPH mold 100, providing a further view of the interior passages 122 and the contour of the screw thread within the body 101 of the TTPH mold 100. The interior passages 122 are shown extending horizontally and vertically through the body 101 of the mold, each interior passage 122 connecting to a respective radial aperture 108 and ventral aperture 120. The interior passages 122 as illustrated are two connected, generally cylindrical spaces in the body 101 of the TTPH mold 100. The radial apertures 108 and the ventral apertures 120 can have equal or different gauges, to accommodate bolts or nuts of varying sizes, where the interior passages 122 have corresponding diameters for each respective aperture. In other embodiments, each interior passage 122 can be a singular space extending through the body 101 of the TTPH mold 100. In further embodiments, the one or more interior passages 122 can connect and be in communication with each other within the body 101 of the TTPH mold 100. In some aspects, the interior passages 122 can extend inward about half of the radius of the TTPH mold 100. The thickness of the body 101 between the interior passages 122 and the interior cavity 112 must be sufficient such that molten metal received within the interior cavity 112 does not melt through the interior screw thread surface 114 and body 101 to breach any interior passage 122.

The obverse contour of the interior screw thread surface 114 is shown within the body 101 of the mold. In particular, the obverse root contour 125 (corresponding to the curved root surface 124) and the obverse crest contour 127 (corresponding to the crest surface 126) are shown with decreasing diameter, along an axis normal to the thread, from the upper opening 110 to the bottom opening 116. Both the major diameter of the thread, following the obverse root contour 125, and the minor diameter of the thread, following the obverse crest contour 127, decrease at a linear and equally varying rate from the upper opening 110 to the bottom opening 116 with in the TTPH mold 100. Further, the width of the obverse crest contour 127 (corresponding to the width of the crest surface 126) is relatively narrower than the width of the obverse root contour 125 (corresponding to the base of the thread of the curved root surface 124).

Further illustrated in the cross-sectional view of the TTPH mold are the normal axis 103 of the thread and the pitch angle line 105 of the thread. The pitch angle line 105 (the taper angle) is illustrated to have an angle of 60°. In other embodiments, the taper angle can be about 15°, about 30°, about 45°, about 75°, of at an angle at an increment or gradient within the range of about 0° to about 180°. In some aspects, the edges of upper opening 110 can track the pitch angle line 105, while the side walls of the bottom opening 116 can be parallel with the normal axis 103 of the thread. In other aspects, the side walls of the bottom opening 116 can have an inclination of about 0° to about 20° inward relative to the normal axis 103 of the thread, so as to reduce the change of angle between the pitch angle line 105 and the side walls of the bottom opening 116. The diameter of the bottom opening 116 is initially drilled to provide clearance for the thread form cutting tool during machining of the TTPH mold 100. The taper of the bottom opening 116 bore provides for easy release of cast metal at that location.

Figure 8:
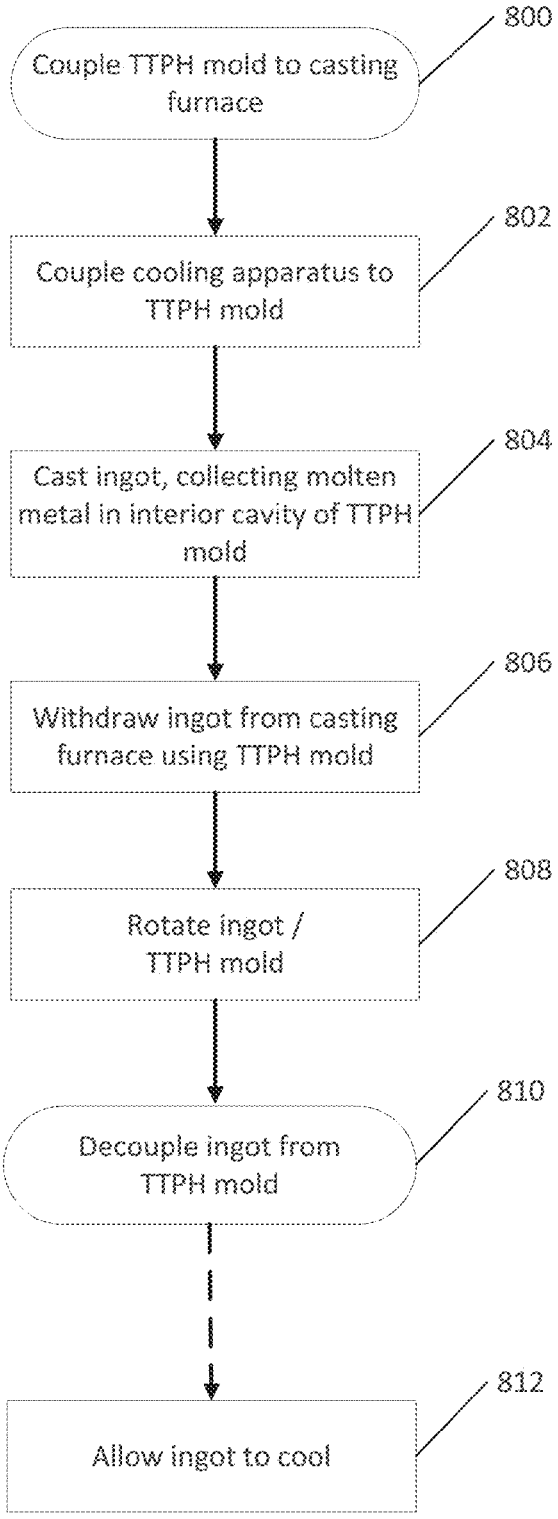
FIG. 8 is a flowchart illustrating an exemplary method of casting an ingot using a tapered treaded puller head casting mold, in accordance with some embodiments of the present disclosure.

FIG. 8 is a flowchart illustrating an exemplary method of casting an ingot using a tapered treaded puller head casting mold. In many aspects, the ingot cast using a TTPH mold can be a narrow-core ingot. At block 800, the TTPH mold is coupled and secured to a casting furnace. If the TTPH mold is an open-bottom mold, an additional cover or cap is also attached to the casting furnace to prevent leakage of molten metal through the TTPH mold. At block 802, the TTPH mold can coupled to a cooling apparatus, generating a thermal gradient and acting as a heat sink when molten metal is present in the interior cavity of the TTPH mold. In some implementations, the TTPH mold can be indirectly cooled by bolting the TTPH mold to a directly water cooled copper plate that has an incorporated vacuum seal between the water and the vacuum chamber atmosphere. At block 804, an ingot is cast in the casting furnace, with a portion of the molten metal for the casting collecting in the interior cavity of the TTPH mold. The TTPH mold can thus define the shape of one end, a tapered male screw end, of the cast ingot.

At block 806, the cast ingot can be withdrawn from the casting furnace by decoupling the ingot out of the casting furnace by way of the TTPH mold. A pulling mechanism mechanically coupled to the TTPH mold (e.g. via bolts and barrel nuts inserted into the TTPH mold) can be used to exert a pulling force to draw out the ingot. At block 808, the cast ingot and the TTPH mold are rotated relative to each other to disengage from each other. In some aspects, the cast ingot can be rotated along the lead of the screw thread to disengage from the TTPH mold. In various aspects, the degree of rotation needed to disengage the TTPH mold from the ingot (where a single turn is 360° of rotation) can be a half-turn (180°), a third-turn (120°), a quarter-turn (90°), a sixth-turn (60°), an eighth-turn (45°), or a turn at other increments or gradients within a single turn range. At block 810, the ingot is decoupled from the TTPH mold. In other words, the ingot is rotated relative to the TTPH mold to decouple from the TTPH mold. In alternative implementations, the TTPH mold can be rotated relative to the ingot to achieve decoupling. At block 812, the ingot can be allowed to cool for a period of time before use in post-casting applications.

Post-casting applications for an ingot formed by the disclosed apparatus and method can include grinding or otherwise reducing the tapered end down to a point for dripping the ingot alloy in a powder production process, such as an Electrode Induction Gas Atomization System (EIGA) or similar system. In other applications, the tapered end can be severed from the main body of the ingot and recycled for use in later melts or castings. In further applications, the male thread profile of an ingot cast according to the present disclosure can be used as a general retention mechanism in a secondary process. In other words, the male screw end of the ingot can be inserted and secured to a secondary processing apparatus having a corresponding female thread cavity. In such applications, the thread form that allows the material to be cast into and then removed from the female cavity of the TTPH mold be subsequently screwed into a second identical female cavity with no loss of functionality, or issues relating to material shrinkage from the casting process.

While particularly advantageous for pulling narrow-core ingots from a casting furnace, a TTPH mold as disclosed herein is not limited only to application with narrow-core ingots. Standard-core ingots can be formed and withdrawn from casting furnaces using a proportionally-sized TTPH mold. In other words, the TTPH mold of the present disclosure can be designed and constructed for use as a puller head that can couple with ingots of varying diameter. Standard-core ingots formed with a TTPH mold can be used for post-casting applications and secondary processes that take advantage of the shape of the male thread end of the cast ingot. TTPH molds designed for forming standard-core ingots can have a proportionally larger width, height, and number of threads. The size of a puller mechanism, bolts, and nuts used with a TTPH mold used with standard-core ingot formation can also be proportional to the diameter of the ingot cast. In some embodiments, a TTPH mold can be used in the formation of ingots having a diameter of four to twenty inches (4"-20"), at any increment or gradient of diameter within that range. Specifically, a TTPH mold can be used in the formation of ingots having a diameter of six inches (6"), eight inches (8"), ten inches (10"), twelve inches (12"), or fourteen inches (14"). Further embodiments of the TTPH mold can be constructed for use in the formation of ingots of greater than twenty inches (>20").

Figure 9:
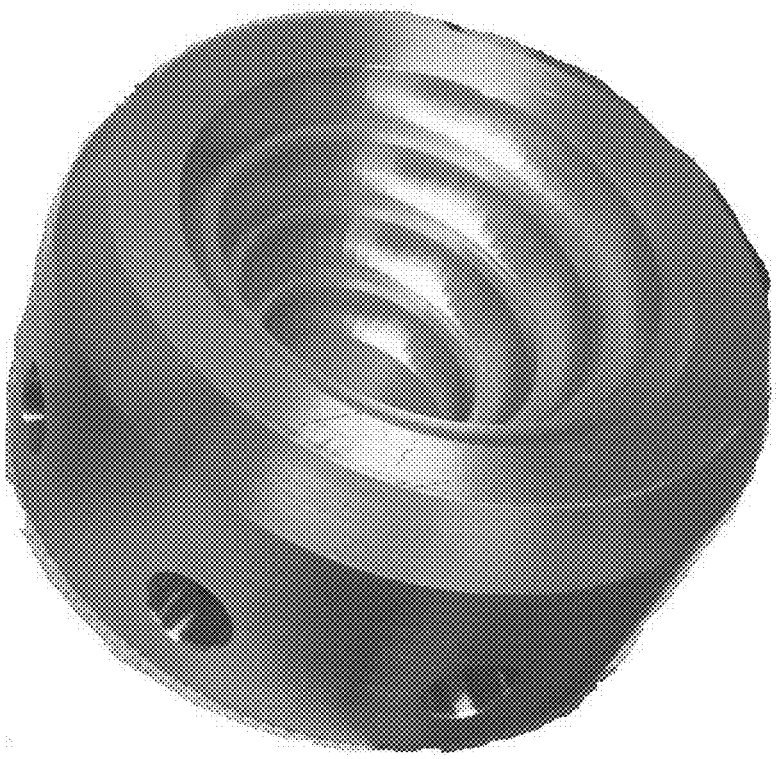
FIG. 9 is an image of a tapered treaded puller head casting mold, in accordance with some embodiments of the present disclosure.

FIG. 9 is an image of a tapered treaded puller head casting mold, shown from a perspective view. The image of the TTPH mold shows apertures in the radial sidewall of the mold leading to interior passages, as well as the tapered threading of in the interior surface of the TTPH mold. The TTPH mold shown in FIG. 9 is made of copper. In alternative embodiments, the TTPH mold can be made of other metals or alloys that can conduct heat sufficiently to draw heat from molten metal in the interior cavity of the TTPH mold to the interior passages such that the TTPH mold does is not damaged or melted to the point of not being functional. Such alloys can be primarily made of copper. In other embodiments, the TTPH mold can be made of alloys including, but not limited to steel, stainless steel, molybdenum (Mo), tantalum (Ta), nickel-based alloys, brass, and/or aluminum bronze.

Figure 10:
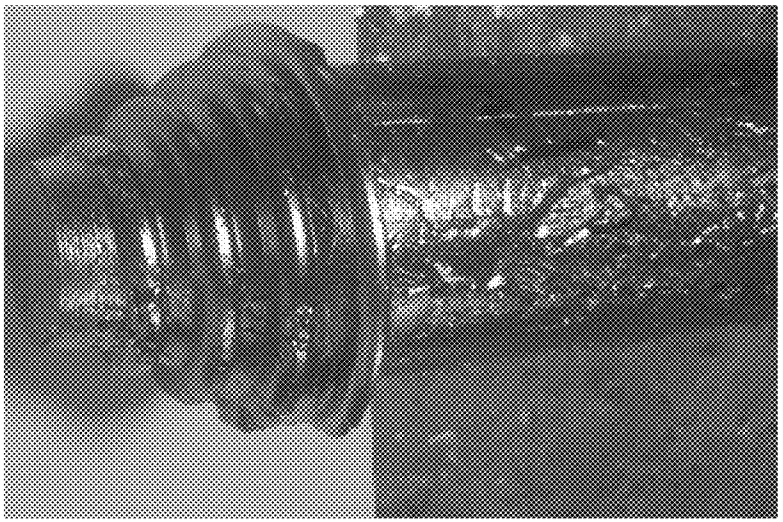
FIG. 10 is an image of an ingot, having one end of the ingot cast in a tapered treaded puller head casting mold, in accordance with some embodiments of the present disclosure.

FIG. 10 is an image of an ingot, having one end of the ingot cast in a tapered treaded puller head casting mold. The end of the ingot has a tapered, curved screw thread that is the male counterpart to the female screw thread shape of the corresponding TTPH mold.

Figure 11:
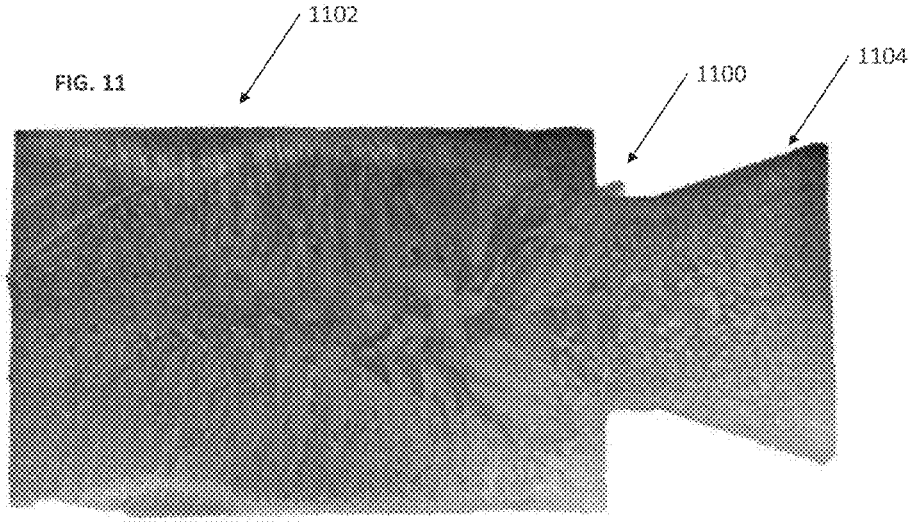
FIG. 11 is an image of a cross-sectioned ingot having a dovetail end formed by a conventional dovetail puller-head.
Figure 12:
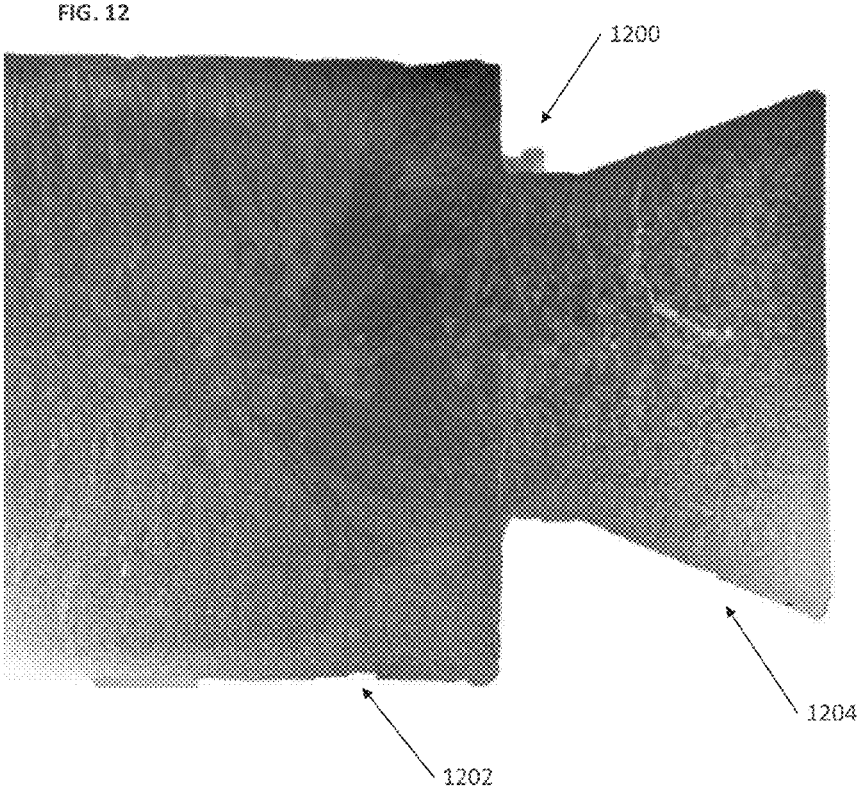
FIG. 12 is an image of a cross-sectioned ingot having a dovetail end formed by a conventional dovetail puller-head (different from the cross-sectioned ingot shown in FIG. 11).

FIG. 11 is an image of a cross-sectioned ingot having a dovetail end 1104 formed by a conventional dovetail puller-head. FIG. 12 is an image of a cross-sectioned ingot having a dovetail end 1204 formed by a conventional dovetail puller-head (different from the cross-sectioned ingot shown in FIG. 11). Both FIG. 11 and FIG. 12 further show the grain structure of a two inch (2") diameter ingot formed with a standard, circular dovetail puller head. Specifically, both cross-sectional images in FIG. 11 and FIG. 12 show a columnar grain structure emanating from the root of the notch 1100, 1200 along the main body 1102, 1202 of each ingot as opposed to the relatively equiaxed grain structure at the base and center of the dovetail portion 1104, 1204 of the respective ingot. The area of interface at the each of the notches 1100, 1200 are substantially narrower than the width of the respective main bodies 1102, 1202. The difference in grain structure between each main body 1102, 1202 of the ingots and their respective dovetail portions 1104, 1204 may be in part a result of a change in how molten metal collects and distributes once at or above the interface defined by the relatively narrow respective notches 1100, 1200. An uneven distribution of grain, structural imperfections, or other directional bias in ingot formation can lead to flaws in metal or alloy products made with such ingots.

Figure 13:
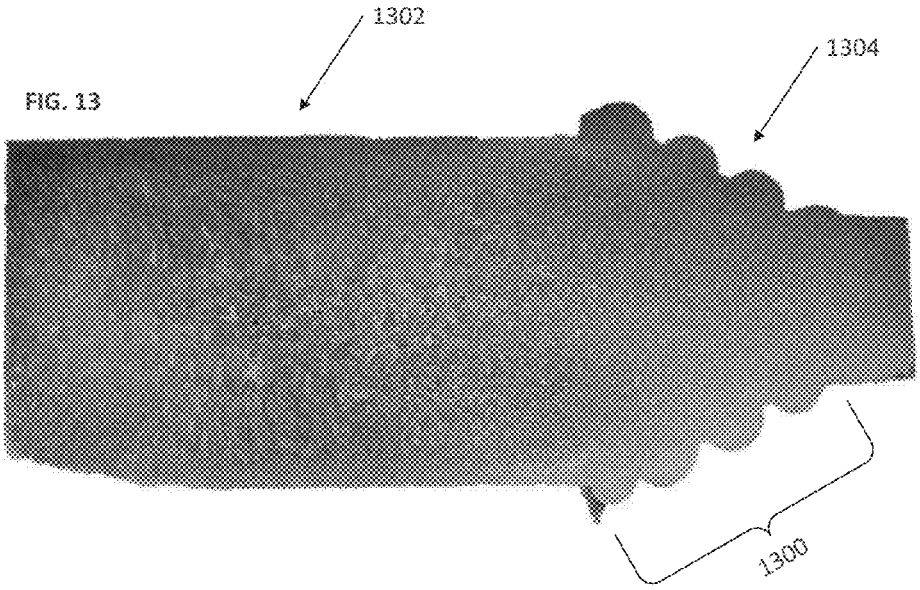
FIG. 13 is an image of a cross-sectioned ingot having a male screw end formed by a tapered treaded puller head casting mold, in accordance with some embodiments of the present disclosure.
Figure 14:
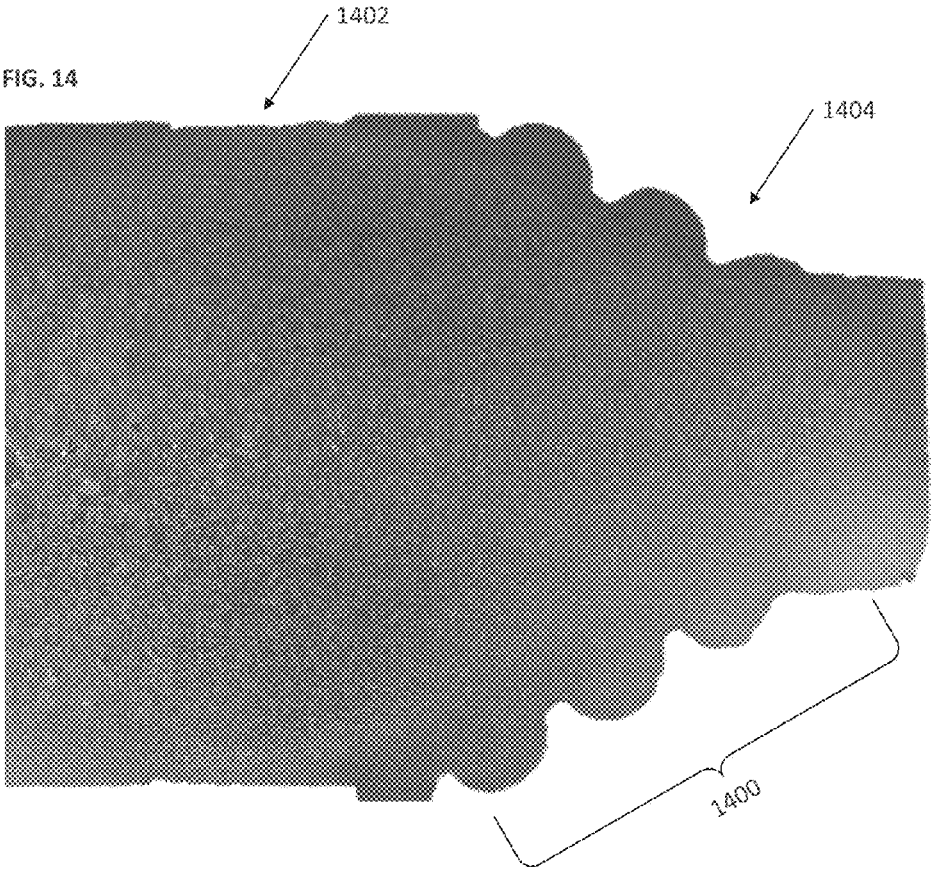
FIG. 14 is an image of a cross-sectioned ingot having a male screw end formed by a tapered treaded puller head casting mold (different from the cross-sectioned ingot shown in FIG. 13), in accordance with some embodiments of the present disclosure.

FIG. 13 is an image of a cross-sectioned ingot having a male screw end 1304 formed by a tapered treaded puller head casting mold, particularly showing the external contour 1300 of the male screw end 1304. FIG. 14 is an image of a cross-sectioned ingot having a male screw end 1404 formed by a tapered treaded puller head casting mold (different from the cross-sectioned ingot shown in FIG. 13), particularly showing the external contour 1400 of the male screw end 1404. Both FIG. 13 and FIG. 14 show the grain structure of a two inch (2") diameter ingot formed with a TTPH mold. As opposed to a notch, the main body 1302, 1402 of the each ingot transitions to the respective male screw ends 1304, 1404 starting with an interface diameter equal to or greater than the diameter of the main body 1302, 1402. Both cross-sectional images in FIG. 13 and FIG. 14 show a fine grain structure throughout the main body 1302, 1402 of the ingots and the male screw end 1304, 1404 of the ingots formed to have a tapered shape. The fine, equiaxed grain structure of the ingot is generally equally distributed throughout the ingot.

The diameter of the male screw ends 1304, 1404 at their widest points are wider than diameter of their respective main bodies 1302, 1402. The additional width may allow for molten metal at the interface of a male screw end and a main body to spread out evenly without applying excess force toward the interior of an ingot, thereby contributing an equally distributed even grain structure. Further, during cooling of the ingot, the additional material of the male screw ends 1304, 1404 that extends past the diameter of their respective main bodies 1302, 1402 may also provide for structural support and strain relief as the ingot cools. In some aspects, the additional mass of metal at the male screw ends 1304, 1404 may lead to a slower cooling, and thus less thermal shock, at the end of the main body 1302, 1402 that would otherwise be directly exposed to the surrounding environment.

The above description is illustrative and is not restrictive, and as it will become apparent to those skilled in the art upon review of the disclosure, that the present invention may be embodied in other specific forms without departing from the essential characteristics thereof. For example, any of the aspects described above may be combined into one or several different configurations, each having a subset of aspects. Further, throughout the foregoing description, for the purposes of explanation, numerous specific details were set forth in order to provide a thorough understanding of the invention. It will be apparent, however, to persons skilled in the art that these embodiments may be practiced without some of these specific details. These other embodiments are intended to be included within the spirit and scope of the present invention. Accordingly, the scope of the invention should, therefore, be determined not with reference to the above description, but instead should be determined with reference to the following and pending claims along with their full scope of legal equivalents.

What is claimed is:

1. A puller head casting mold, comprising:

a mold body having an annular shape with an upper surface, a bottom surface, a radial surface, and an interior screw thread surface;

wherein the interior screw thread surface defines an interior cavity, and the interior screw thread surface is tapered to narrow a diameter of the interior cavity along an axis normal to the mold body from the upper surface to the bottom surface, and wherein each of one or more interior passages extends into the mold body from the radial surface about half the radius of the annular mold body.

2. The puller head casting mold of claim 1, wherein the upper surface has an opening that further defines an upper plane of a casting space.

3. The puller head casting mold of claim 1, wherein the taper of the threaded interior surface has an angle of about 0° to about 180°.

4. The puller head casting mold of claim 3, wherein the taper of the threaded interior surface has an angle of about 60°.

5. The puller head casting mold of claim 1, wherein the threaded interior surface has a curved crest surface forming a rounded thread or a partially spherical thread.

6. The puller head casting mold of claim 5, wherein the threaded interior surface has a root surface that is about 10% or less of the width of the curved crest surface.

7. The puller head casting mold of claim 6, wherein the threaded interior surface has a root surface that is about 5% the width of the curved crest surface.

8. The puller head casting mold of claim 1, further comprising a beveled edge connecting the upper surface and the radial surface, having a bevel angle of from about 5° to about 60° below the upper surface.

9. The puller head casting mold of claim 1, wherein the mold is configured to form ingots having a main body diameter of about two inches to about four inches.

10. The puller head casting mold of claim 1, wherein the mold is configured to form ingots having a main body diameter of about four inches to about twenty inches.

11. A method of forming a cast ingot, comprising:

positioning a tapered threaded puller head having an interior cavity proximate to an extrusion port of a furnace casting system, wherein the tapered threaded puller head comprises a mold body having an annular shape with an upper surface, a bottom surface, a radial surface, and an interior screw thread surface, wherein the interior screw thread surface defines an interior cavity and is tapered to narrow a diameter of the interior cavity along an axis normal to the mold body from the upper surface to the bottom surface, and wherein each of one or more interior passages extends into the mold body from the radial surface about half the radius of the annular mold body;

casting an ingot in the furnace casting system, wherein one end of the ingot passes through the extrusion port and is cast within the interior cavity of the tapered threaded puller head;

withdrawing the ingot from the furnace casting system by moving the tapered threaded puller head away from the extrusion port, concurrently pulling the ingot out of the extrusion port; and removing the tapered threaded puller head from the ingot.

12. The method according to claim 11, wherein decoupling the tapered threaded puller head from the ingot comprises rotating the cast ingot less than a full turn relative to the tapered threaded puller head.

13. The method according to claim 11, wherein decoupling the tapered threaded puller head from the ingot comprises rotating the cast ingot a quarter-turn relative to the tapered threaded puller head.

14. The method according to claim 11, wherein decoupling the tapered threaded puller head from the ingot comprises rotating the cast ingot a sixth-turn relative to the tapered threaded puller head.

15. The method according to claim 11, wherein decoupling the tapered threaded puller head from the ingot comprises rotating the tapered threaded puller head less than a full turn relative to the cast ingot.

16. The method according to claim 11, wherein the cast ingot has a main body diameter of about two inches to about four inches.

17. The method according to claim 11, wherein the cast ingot has a main body diameter of about four inches to about twenty inches.

18. The method according to claim 11, wherein the cast ingot has a tapered male screw end.

19. The method according to claim 11, wherein the cast ingot has an equiaxed grain structure.

* * * * *